US008540450B1

(12) United States Patent
Conable

(10) Patent No.: US 8,540,450 B1
(45) Date of Patent: Sep. 24, 2013

(54) PEN CAP ATTACHMENT MECHANISM

(76) Inventor: Matthew Conable, McMinnville, OR (US)

( * ) Notice: Subject to any disclaimer, the term of this patent is extended or adjusted under 35 U.S.C. 154(b) by 382 days.

(21) Appl. No.: 12/944,255

(22) Filed: Nov. 11, 2010

Related U.S. Application Data

(60) Provisional application No. 61/260,174, filed on Nov. 11, 2009.

(51) Int. Cl.
*B43K 23/12* (2006.01)

(52) U.S. Cl.
USPC ..... 401/243; 401/246; 401/247

(58) Field of Classification Search
USPC ..... 401/243, 246, 247
See application file for complete search history.

(56) References Cited

U.S. PATENT DOCUMENTS

| | | | | |
|---|---|---|---|---|
| 454,623 | A | 6/1891 | Baumgarten | |
| 2,416,112 | A | 2/1947 | Moore | |
| 2,952,242 | A * | 9/1960 | Rosso | 401/108 |
| 3,666,373 | A * | 5/1972 | Reed | 401/247 |
| 4,380,403 | A | 4/1983 | Endres et al. | |
| 4,780,016 | A * | 10/1988 | Kim | 401/117 |
| 5,971,647 | A | 10/1999 | Loulourgas | |
| 7,001,093 | B2 * | 2/2006 | Rosso | 401/131 |
| 2002/0110404 | A1 * | 8/2002 | Saitou | 401/244 |
| 2007/0172301 | A1 * | 7/2007 | Rolion et al. | 401/117 |

* cited by examiner

*Primary Examiner* — Gregory Huson
*Assistant Examiner* — Joshua Wiljanen
(74) *Attorney, Agent, or Firm* — Dwayne E. Rogge; Schacht Law Office, Inc.

(57) ABSTRACT

In general, this disclosure relates to a pen housing mechanism, comprising at least one locking collar provided on a pen body configured to receive a pen cap, specifically a pen cap having a plurality of inset "balls" that engage channels within the locking collar. In one form, the "balls" are fit into voids drilled or otherwise provided in a portion of the pen cap and press fit, or otherwise attached, thereto. In one form, a compression spring is provided, which biases the "balls" into a locking portion of the channel.

10 Claims, 8 Drawing Sheets

PEN CAP ATTACHMENT MECHANISM

RELATED APPLICATIONS

This application claims priority benefit of U.S. Ser. No. 61/260,174, filed on Nov. 11, 2009 and incorporated herein by reference.

BACKGROUND OF THE DISCLOSURE

Field of the Disclosure

This disclosure relates to the field of desk pens with removable cap assemblies wherein the cap assemblies attach to the main pen body by way of a tension bayonet mount.

SUMMARY OF THE DISCLOSURE

Disclosed herein is a writing implement assembly, comprising a pen body having a writing end and a pen cap having an open end operatively configured to fit over a portion of the writing end of the pen body. A plurality of voids are disposed thorough the open end of the pen cap, and a rigid ball is fixedly set within each void disposed through the open end of the pen cap. A plurality of receiving channels is provided on the writing end of the pen body, and the receiving channels are operatively configured to receive a portion of the balls.

In one form, the writing implement assembly described above is arranged so that the balls are spherical, although spheroid balls may also work. The receiving channels in the pen body are non-linear from a side view to facilitate a locking arrangement, such as a standard, bayonet-style mechanism. The writing implement assembly may be configured wherein the receiving channels are substantially c-shaped from a side view, although other shapes may work equally well. The balls may be press fit into the voids disposed thorough the open end of the pen cap, or they may be welded, adhered, or otherwise affixed. The writing implement assembly may be arranged wherein the writing end of the pen body comprises a fountain pen writing tip or a rolling style writing tip.

In one embodiment of the assembly, the pen cap further comprises a compression spring, which is operatively configured to engage the writing end of the pen body and is operatively configured to bias the pen cap away from the pen body, wherein each of the receiving channels comprises at least one entry portion and at least one locking portion, and wherein the compression spring biases the balls within the locking portion of the receiving channels.

The writing implement described herein may further comprise a cap receiver portion provided on the pen body at the longitudinal end opposite the writing end, a plurality of receiving channels provided on the writing end of the pen body, wherein the receiving channels are operatively configured to receive a portion of the balls of the pen cap.

DESCRIPTION OF THE PREFERRED EMBODIMENTS

In general, this disclosure relates to a pen housing mechanism, comprising at least one locking collar provided on a pen body configured to receive a pen cap, specifically a pen cap having a plurality of inset "balls" that engage channels within the locking collar. In one form, the "balls" are fit into voids drilled or otherwise provided in a portion of the pen cap and press fit, or otherwise attached, thereto wherein they provide a functional purpose on the inner portion of the pen cap, and provide a decorative element outside the cap. The balls may be made of metals, ceramics, polymers, or equivalent materials. In one form, a compression spring is provided, which biases the "balls" into a locking portion of the channel.

Figure 1:
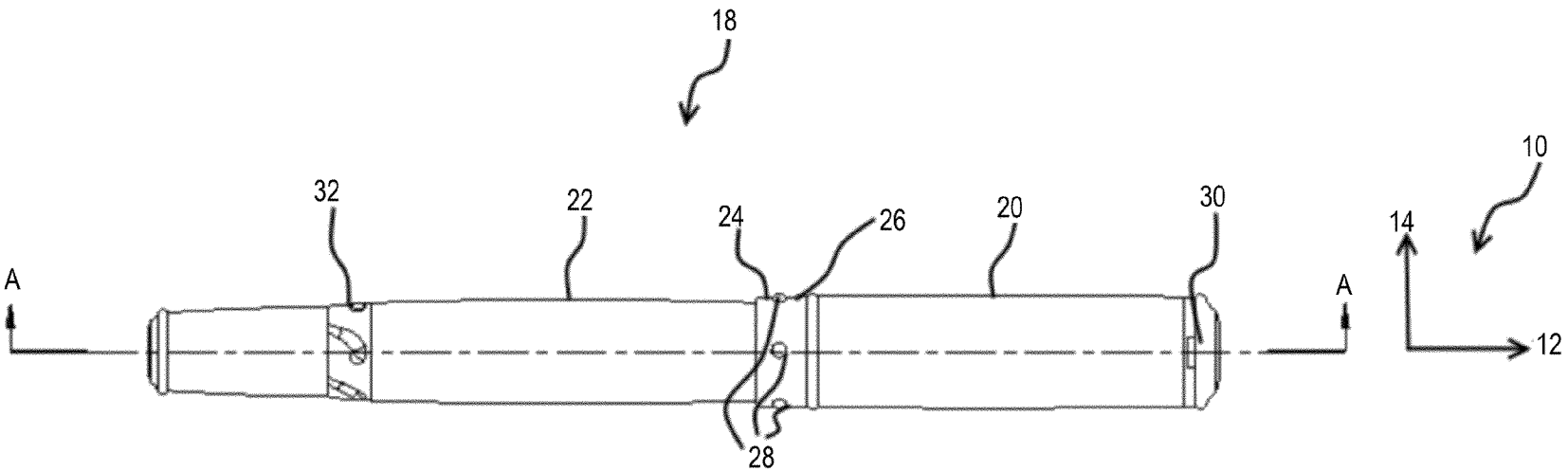
FIG. 1 is a side view of an assembled pen, in one form.

Before beginning a detailed description of the embodiments, an axis system 10 is shown in FIG. 1, comprising a longitudinal axis 12 and a radial axis 14. As the pen 18 will ordinarily be substantially a cylinder, the longitudinal axis 12 aligns with the center of this cylinder, and the radial axis 14 extends outward therefrom. These axes are intended to be used for description only and are not intended to be limiting.

As shown in FIG. 1, as with most pens, the novel mechanism disclosed herein comprises a pen cap 20, which is removably attached to a pen body 22. Each of these portions has novel features. The pen cap 20 comprises an open end 24 which fits over a portion of the pen body 22, as will be discussed. Near the open end 24 are a plurality of surfaces defining voids or holes 26, into which are attached a plurality of rigid balls 28. The balls 28 may be press fit into the voids 26, or they may be adhered, welded, soldered, heat fit, or otherwise attached thereto, thus becoming a rigid and attached portion of the pen 18. Also shown is a clip slot 30 which may be incorporated where a pocket clip, not shown, is attached using known methods. The pen body 22 in one form also comprises a cap receiver portion 32, configured to receive the open end 24 of the pen cap 20 when the pen 18 is in use. Looking to FIG. 2, the pen body 22 is shown in one embodiment, disassembled to show the interoperating portions thereof. The writing tip and ink housing are removed and not shown for clarity. In one form, the pen body 22 comprises a writing end 34 and a body cap end 36.

In one form, an accent ring 38 is provided, which has functionality described later on and also increases the aesthetic value of the pen 18. The accent ring 38, in one form, attaches to an inset shoulder 40 on a finger grip 42. The finger grip 42 is coupled to a grip retainer 44 by press fitting thereto or other methods. The grip retainer 44, in one form, is attached to a writing end receiver 46 in one form by way of male threads 48, disposed on the grip retainer 44, and female threads 50, provided within the writing end receiver 46. The writing end receiver 46, in one form, comprises the receiving channels 52 previously discussed. These receiving channels 52 will be discussed in much more detail. In one form, the writing end receiver 46 comprises a shoulder 60, which engages an interior portion 54 of an overlay 56 and is press fit or otherwise attached thereto. The overlay 56 comprises a substantially hollow tube or equivalent structure, which may be formed of metal, plastic, wood, or a combination thereof. These overlays 56 are well known in the art in many different varieties. In one form, a body cap end receiver (overlay retainer) 58 is included, which comprises the cap receiver portion 32 previously discussed. Once again, the body cap end receiver 58 may comprise a shoulder 61, which engages the interior portion 54 of the overlay 56 and is press fit or otherwise attached thereto. A body cap 62 may also be provided, including male threads 64 which engage female threads within the body cap end receiver 58 to attach the body cap 62 thereto. In a desk-style pen, wherein the pen cap is left on the desk and is not attached to the body cap end 36, the body cap end receiver 58 may be omitted, wherein the body cap 62 is directly attached to the overlay 56, or the body cap end receiver 58 does not include channels to engage the pen cap. In one form, a decorative end cap 66 may be provided, including threads 68, which engage threads within the body cap 62. In another form, the end cap 66 and body cap 62 are a unitary structure. Additionally, the body cap 62 and body cap end receiver 58 may be a unitary structure.

Figure 3:
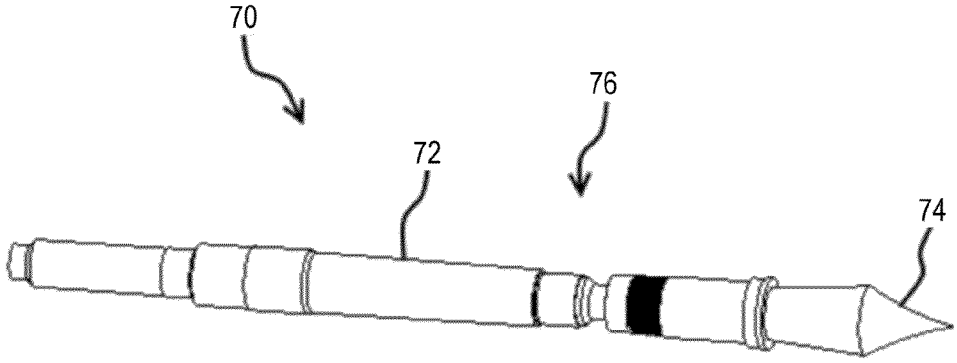
FIG. 3 is an isometric view of the interior components of a fountain pen, in one form.

Looking to FIG. 3, the internal components of a fountain pen 70 are shown, including a fountain body 72, which may include an ink cartridge and a fountain tip 74, as is commonly known in the art. These internal components 76 are shown also within the pen 18 in FIG. 5.

Figure 2:
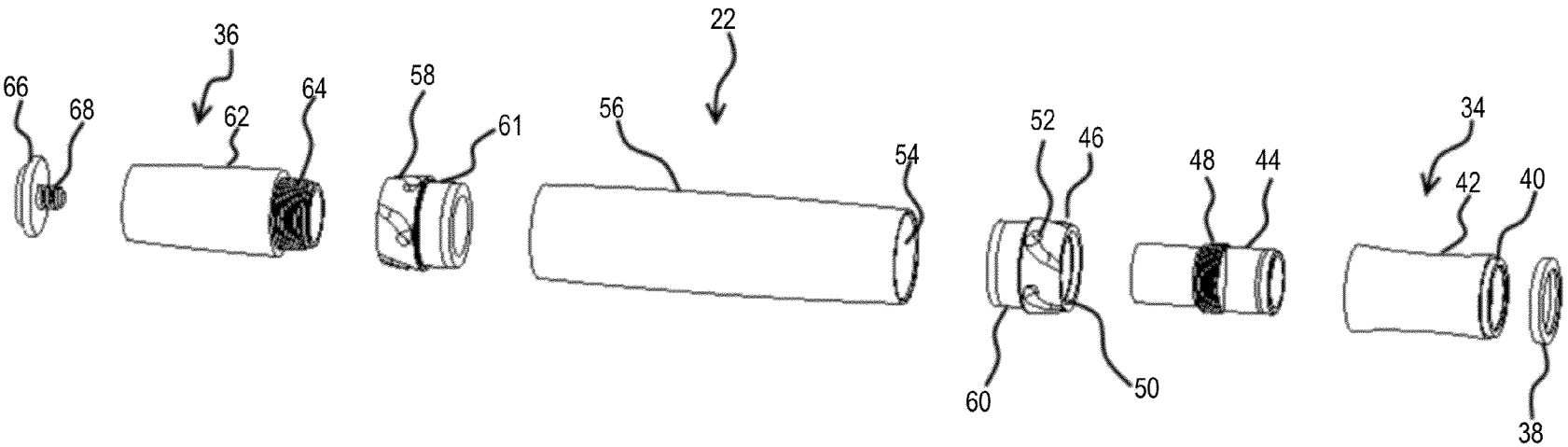
FIG. 2 is an isometric view of a disassembled pen body, in one form.
Figure 4:
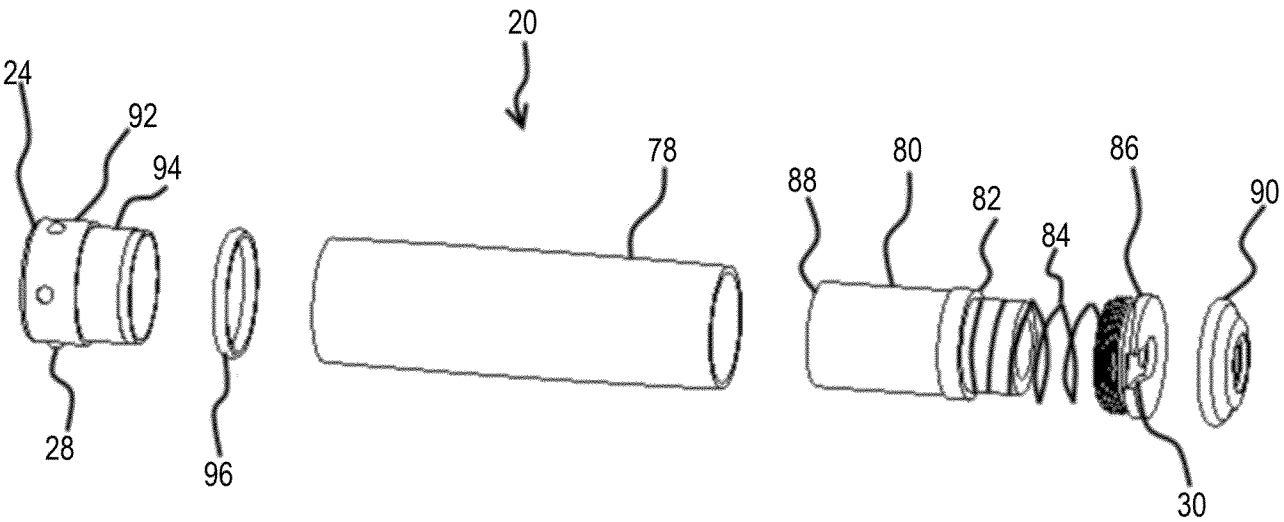
FIG. 4 is an isometric, exploded view of a pen cap, in one form.
Figure 5:
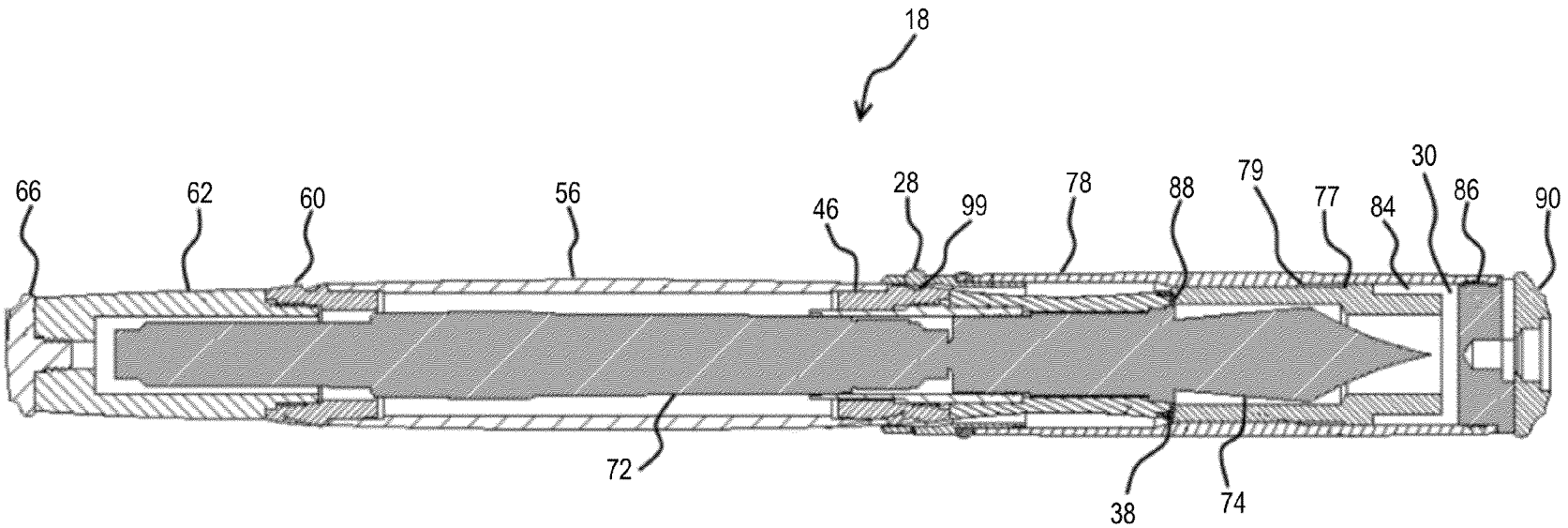
FIG. 5 is a cutaway view of a fountain pen taken along line A-A of FIG. 1.
Figure 6:
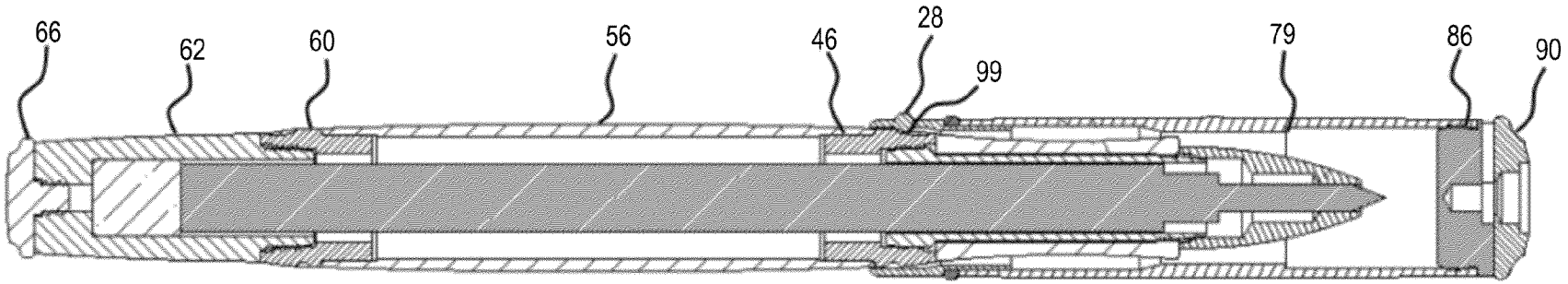
FIG. 6 is a cutaway view of a roller pen taken along line A-A of FIG. 1.

Looking to FIG. 4, the pen cap 20 is shown in one form. A tube-like cap overlay 78 is shown, which will normally be complementary to the overlay 56 of the pen body 22, as shown in FIG. 2. In one form, a spring sleeve 80 is press fit or otherwise attached to the cap overlay 78. A shoulder 82 may be provided in one end of the spring sleeve 80 to align and position a compression spring 84. A cap plug 86 may also engage the spring 84, and when engaged upon the tube 78, the spring will bias the spring sleeve 80 toward the open end 24. As can be seen in FIG. 5, as the spring sleeve 80 is allowed to slide within a portion of the cap overlay 78 until a shoulder 77 engages an internal shoulder 79 within the cap overlay 78 (shown in FIGS. 5 and 6), the engagement end 88 of the spring sleeve 80 engages a portion of the pen body 22, as shown in FIG. 5. In one form, the engagement end 88 will come into contact with the accent ring 38. A clip screw 90 may also be provided, which is attached to the cap plug 86 by way of a threaded portion or other methods, or it may be formed as a unitary structure therewith. In one form, the clip screw 90 retains a pocket clip (not shown) within the clip slot 30 previously described.

Attached to the cap overlay 78, on an opposite end from the clip screw 90 is a ball retainer 92, which comprises a shoulder 94, as shown in FIG. 4, to allow the ball retainer 92 to be press fit or otherwise attached to the interior portion of the cap overlay 78. A ring or cap accent 96 may be attached between the ball retainer 92 and cap overlay 78.

Figure 7:
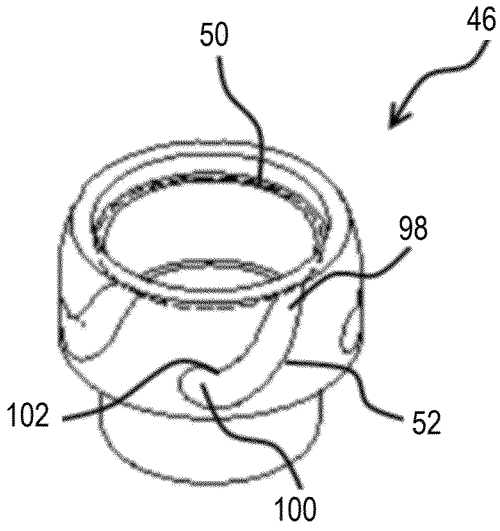
FIG. 7 is an isometric view of a locking collar, in one form.
Figure 8:
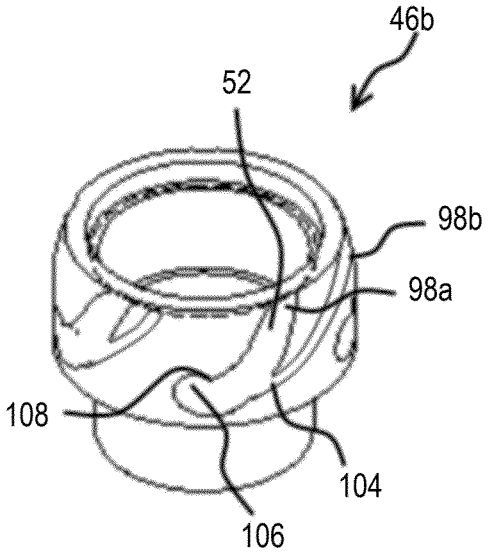
FIG. 8 is an isometric view of another locking collar, in one form.

Looking to FIGS. 7 and 8, a detailed view of the writing end receiver 46 is shown. This figure shows the receiving channels 52 in more detail. While alternative embodiments can be envisioned, a C-shaped receiving channel, as shown in FIG. 7, comprises a single entry portion 98 and a locking portion 100 in each of the receiving channels 52. Each of the receiving channel 52 is configured to receive the interior portion 99 (see FIGS. 4, 5 and 6) of the balls 28 within the ball retainer 92. As the balls 28 are fit within voids 26, the interior portion 99 of the balls 28 will extend into the interior portion of the ball retainer 92. It is this interior portion 99 of the balls 28 that engages the receiving channels 52. As the balls 28 slide through the entry portion 98, the spring 84 within the pen cap 20 compresses, and as the interior portion of the balls 28 slides past the sear point 102 and into the locking portion 100, the spring 84 biases, maintaining placement of the pen cap 20 upon the pen body 22.

In the embodiment shown in FIG. 8, there are a plurality of entry portions 98*a* and 98*b*, which come together at a merging portion 104 into a single locking portion 106 and a single seer point 108. Thus, is much quicker and easier to engage the pen cap 20 against the pen body 22, as the user need only align the interior portion of the balls 28 with either the entry portion 98*a* or the entry portion 98*b*. This doubles the number of entry portions around the circumference of the writing end receiver 46*b* with the same number of locking portions 106.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A writing implement assembly comprising:

a. a pen body having a writing end, and a longitudinal axis;

b. a pen cap having an open end operatively configured to fit over a portion of the writing end of the pen body;

c. a plurality of voids disposed through the open end of the pen cap;

d. a plurality of rigid balls fixedly set within the voids disposed through the open end of the pen cap wherein the rigid balls extend inward of the pen cap and outward of the pen cap;

e. a plurality of receiving channels provided on the writing end of the pen body; and f. wherein the receiving channels are operatively configured to receive a portion of the balls to maintain the pen cap upon the pen body.

2. The writing implement assembly of claim 1 wherein the balls are spherical.

3. The writing implement assembly of claim 1 wherein the receiving channels are non-linear from a side view.

4. The writing implement assembly of claim 3 wherein the receiving channels are substantially c-shaped from a side view.

5. The writing implement assembly of claim 1 wherein the balls are press fit into the voids disposed thorough the open end of the pen cap.

6. The writing implement assembly of claim 1 wherein the writing end of the pen body comprises a fountain pen writing tip.

7. The writing implement assembly of claim 1 wherein the writing end of the pen body comprises a rolling style writing tip.

8. The writing implement assembly of claim 1 wherein the pen cap further comprises a. a compression spring operatively configured to engage the writing end of the pen body and the compression spring is operatively configured to bias the pen cap away from the pen body along the longitudinal axis of the pen body;

b. wherein each of the receiving channels comprise at least one entry portion and at least one locking portion; and c. wherein the compression spring biases the balls within the locking portion of the receiving channels.

9. The writing implement assembly of claim 1 further comprising:

a. a cap receiver portion provided on the pen body at the longitudinal end opposite the writing end;

b. a plurality of receiving channels provided on the cap receiver portion of the pen body; and c. wherein the receiving channels on the cap receiver portion of the pen body are operatively configured to receive a portion of the balls of the pen cap.

10. The writing implement assembly of claim 3 wherein the receiving channels are substantially y-shaped from a side view.

* * * * *